US005230716A

United States Patent [19]

Notestein

[11] Patent Number: 5,230,716

[45] Date of Patent: Jul. 27, 1993

[54] GRATE ASSEMBLY FOR FIXED-BED COAL GASIFIER

[75] Inventor: John E. Notestein, Morgantown, W. Va.

[73] Assignee: The United States of America as represented by the United States Department of Energy, Washington, D.C.

[21] Appl. No.: 913,095

[22] Filed: Jul. 14, 1992

[51] Int. Cl.[5] ..... C10J 3/42

[52] U.S. Cl. ..... 48/62 R; 48/63; 48/66; 48/77; 48/87; 126/182

[58] Field of Search ..... 48/62 R, 63, 64, 66, 48/67, 68, 69, 76, 77, 85.1, 85.2, 87, 111; 126/182, 173; 110/247, 170, 275

[56] References Cited

U.S. PATENT DOCUMENTS

| | | | |
|---|---|---|---|
| 1,928,609 | 9/1933 | Ackeren | 48/66 |
| 1,974,205 | 9/1934 | Corbett | 126/182 |
| 2,147,324 | 2/1939 | Van Ackeren | 126/182 |
| 2,200,066 | 5/1940 | Koller | 126/182 |
| 2,494,975 | 1/1950 | West et al. | 126/182 |
| 2,548,086 | 4/1951 | West et al. | 126/182 |
| 2,632,697 | 3/1953 | Hubmann | 126/182 |
| 3,847,562 | 11/1974 | Hamilton | 48/76 |
| 3,930,811 | 1/1976 | Holler | 48/63 |
| 4,088,455 | 5/1978 | Kohler et al. | 48/202 |
| 4,388,876 | 6/1983 | Burton | 110/170 |
| 4,432,772 | 2/1989 | Starke et al. | 126/182 |

*Primary Examiner*—Peter Kratz

*Attorney, Agent, or Firm*—David E. Breeden; Stephen D. Hamel; William R. Moser

[57] ABSTRACT

A grate assembly for a coal gasifier of a moving-bed or fixed-bed type is provided for crushing agglomerates of solid material such as clinkers, tailoring the radial distribution of reactant gases entering the gasification reaction zone, and control of the radial distribution of downwardly moving solid velocities in the gasification and combustion zone. The clinker crushing is provided by pinching clinkers between vertically oriented stationary bars and angled bars supported on the upper surface of a rotating conical grate. The distribution of the reactant gases is provided by the selective positioning of horizontally oriented passageways extending through the grate. The radial distribution of the solids is provided by mounting a vertically and generally radially extending scoop mechanism on the upper surface of the grate near the apex thereof.

14 Claims, 4 Drawing Sheets

GRATE ASSEMBLY FOR FIXED-BED COAL GASIFIER

The United States Government has rights in this invention pursuant to the employer-employee relationship of the U.S. Department of Energy and the inventor.

BACKGROUND OF THE INVENTION

The present invention relates generally to an improved grate arrangement for use in gasification systems, and more particularly to such a grate arrangement in a fixed-bed coal gasifier with the grate arrangement incorporating clinker crushing capabilities together with selective gas and solids flow distribution.

The gasification of coal and other carbonaceous materials such as peat and biomass provides for the production of product gases having high energy values useful in various energy consuming applications such as gas-fired turbine systems. The gasifiers used for the conversion of coal to such product gases include moving bed gasifiers or fixed-bed gasifiers which normally comprise a vertical reaction vessel containing a gasification zone overlying a grate mechanism which supports the downwardly moving solid reactants in the gasification zone. In addition to supporting the solid reactants, the grate mechanism, which may be of a planar or conical configuration provides for the removal of spent solid reactants or ash from the gasification zone as well as other functions including the distribution of gaseous reactants, normally air and steam, that are introduced into the base region of the gasifier and pass upwardly into the gasification zone through the grate mechanism to react with and gasify coal introduced into the top region of the gasifier.

Clinkers formed of fused ash particulates are commonly produced in the lower region of the gasification zone during the gasification process with the extent of such clinker formation being dependent upon the characteristics of the coal and the operational parameters employed in the gasification process. While proper control of steam and air flow is commonly used to limit the extent of clinker formation, crushing of the clinkers which are formed into solids of a size which will pass through or around the edges of the grate mechanism is often required in order to prevent taking the gasifier off-line for removing "excessive" clinkers. Such crushing of clinkers has been achieved by providing the grate mechanism with clinker crushing capabilities such as by employing one or more excentric lobes on the rotating grate and a "wear" ring on the stationary internal diameter.

In order to provide for the distribution of the upwardly flowing reactant gases within the gasification zone, the grate mechanisms are usually provided with throughgoing orifices or passageways placed at various locations about the surface of the grate mechanism. It was previously generally accepted that the grate mechanism should distribute these reactant gases and cause the downflow of solids through the gasification to occur in an areally uniform manner. However, it was recently found in terms of gasifier throughput that the distribution of the upflowing gaseous reactants and the downflowing solids in the gasification zone in a non-areally uniform manner would be more advantageous from an efficiency standpoint in the gasification operation. Thus, while previously known grate mechanisms have been found to provide either a capability for satisfactorily crushing clinkers or a desirable distribution of the reactant gases, none of the previous grate mechanisms have been found to be capable of providing both effective clinker crushing and desirable reactant gas distributing characteristics nor do they address the desirability of adjusting the flow pattern of the reactant gases for effecting an areal or other distribution of the reactant gases or adjusting the flow pattern of solids in the gasification zone.

SUMMARY OF THE INVENTION

It is an object of the present invention to provide a rotatable grate arrangement or assembly for a moving or fixed-bed gasifier used for the gasification coal or any other suitable solid carbonaceous material with the grate arrangement combining a substantial solids crushing capability with a distribution of reactant gases through the grate that is tailorable to provide a uniform or a selectively non-uniform flow of reactant gases through the gasification zone.

Another object of the present invention is to provide such a grate arrangement with a solids distribution capability for tailoring the flow of the downwardly moving solids within the gasification zone such as by providing a flow of such solids in the central region of the gasification zone at a selective rate which may be less than, equal to, or greater than the flow rate of solids in the peripheral regions of the gasification zone surrounding the central region.

A further object of the present invention is to provide a reversible drive mechanism for the grate arrangement whereby the grate may be rotated in a direction opposite to the normal operating and clinker crushing direction for a selected distance in order to enhance the clinker crushing capabilities of the grate arrangement.

Generally, the present invention is directed to grate means for use in a solid carbonaceous reactants gasifier. The gasifier comprises a vertically oriented housing having inner wall regions forming a cylindrical chamber defining a gasification zone located intermediate to upper and lower regions of the housing. The housing is provided with inlet means and outlet means in the upper region thereof for respectively introducing solid reactants into the housing and removing product gases resulting from the gasification of the solid reactants in the gasification zone. The housing is also provided with inlet means and outlet means in the lower region thereof for respectively introducing a stream of reaction-supporting gases into the housing and for discharging spent solids from the housing.

The grate means comprises a grate of a generally conical configuration that is rotatably supported in the cylindrical chamber at a location underlying the gasification zone for supporting downwardly moving solid reactants within the gasification zone. The conical grate has convex surface regions thereon facing the gasification zone and is a diameter slightly less than the inner diameter of the chamber for defining an annular passageway between the inner wall regions of the housing and peripheral edge regions of the grate for the discharge of spent solids from the gasification zone. The grate is also provided with a plurality of throughgoing passageways extending between inner and outer surface regions and the conical assembly for distributing the stream of reaction supporting gases flowing into the gasification zone after entering the housing through the inlet means in the lower region thereof.

To provide for the crushing of clinkers, the inner wall regions of the housing are provided with a plurality of elongated vertically oriented first bar means that supported thereon in a substantially common plane with each of the bar means having a lower end thereof overlying the annular passageway between the grate and the inner wall regions and positioned in a plane vertically spaced from the peripheral edge regions of the grate. A plurality of elongated second bar means are supported on the upper surface regions of the grate with one end portion of each of the second bar means being disposed in a horizontal plane underlying the lower end of the first bar means. Means are provided for rotating the grate in a first direction for contacting and crushing between the first and second bar means solid material defining clinkers of a size larger than the cross section of the annular passageway.

The drive means are adapted to rotate the conical grate in a direction opposite to the first direction for a selected distance sufficient for the reorienting any clinker supported on the upper surface region of the grate.

Each of the plurality of throughgoing passageways in the conical grate is disposed at an angle generally perpendicular to the vertical axis of the chamber for deterring the intrusion of solid material in contact with the conical grate which could result in plugging of any throughgoing passageways.

The grate means also includes vertically oriented and generally radially extending scoop means that is supported on the upper surface region of conical grate. A vertical side of the scoop means is positioned on the grate at a location substantially coincident with the apex of the conical grate. The scoop means is positioned at an angle to the radius of the chamber and is of a size sufficient to displace a selected portion of the solids from the central region of the gasification zone towards the peripheral region thereof.

Other and further objects of the present invention will become obvious upon an understanding of the illustrative embodiments about to be described or will be indicated in the appended claims, and various advantages not referred to herein will occur to one skilled in the art upon employment of the invention in practice.

Preferred embodiments of the invention have been chosen for the purpose of illustration and description. The preferred embodiments illustrated are not intended to be exhaustive nor to limit the invention to the precise forms shown. The preferred embodiments are chosen and described in order to best explain the principles of the invention and their application and practical use to thereby enable others skilled in the art to best utilize the invention in various embodiments and modifications as are best adapted to the particular use contemplated. For example, while the grate assembly is described herein as being utilized within a fixed-bed coal gasifier, it is to be understood that the grate assembly can be utilized in any solids reactor containing a downwardly moving bed of solids, and particularly, if the reacting solids have an agglomerate-forming nature.

DETAILED DESCRIPTION OF THE INVENTION

Figure 1:
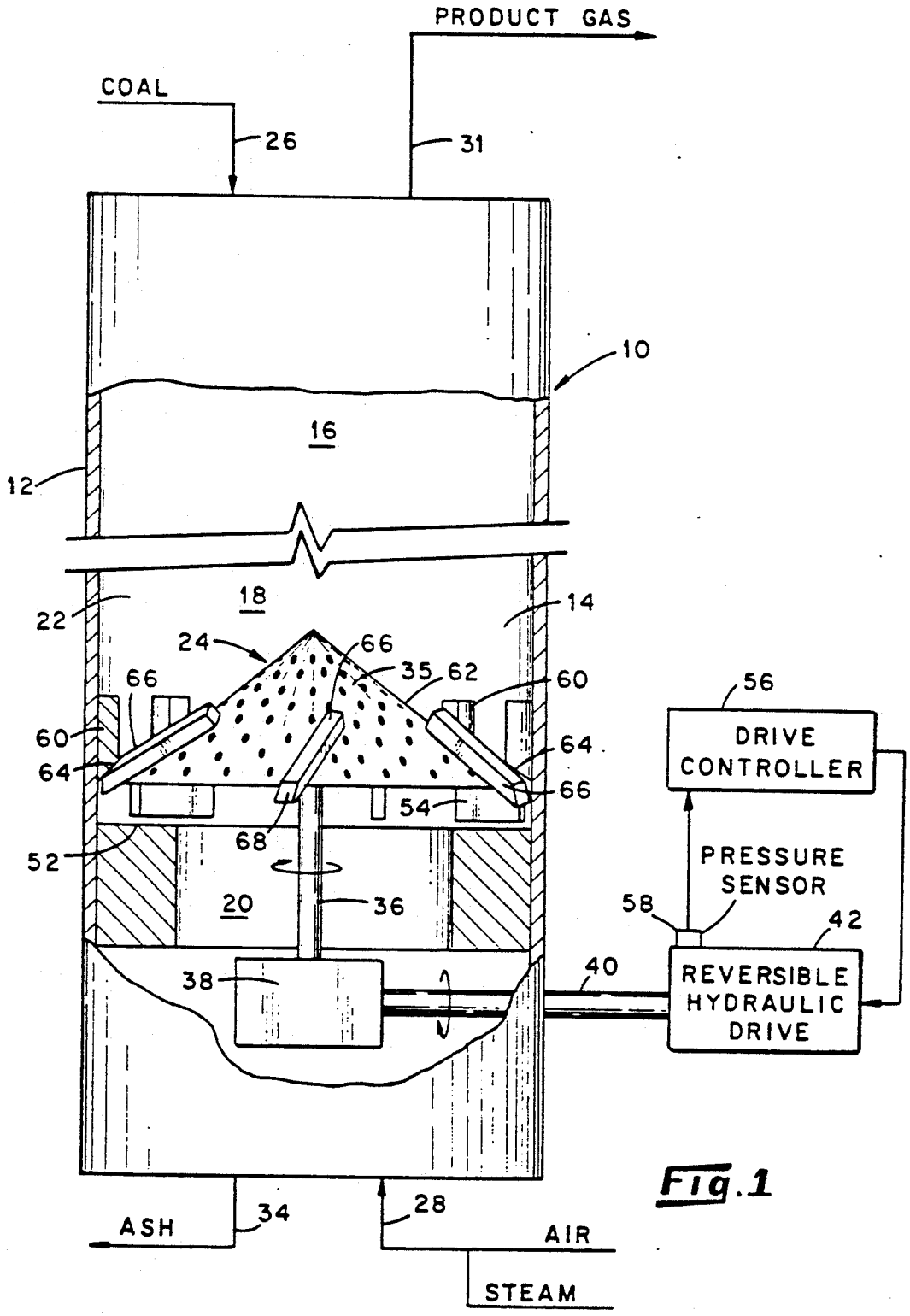
FIG. 1 is a vertical sectional view generally illustrating a fixed-bed coal gasifier with a rotatable grate assembly incorporating the clinker crushing and reactant gas distribution features of the present invention.
Figure 2:
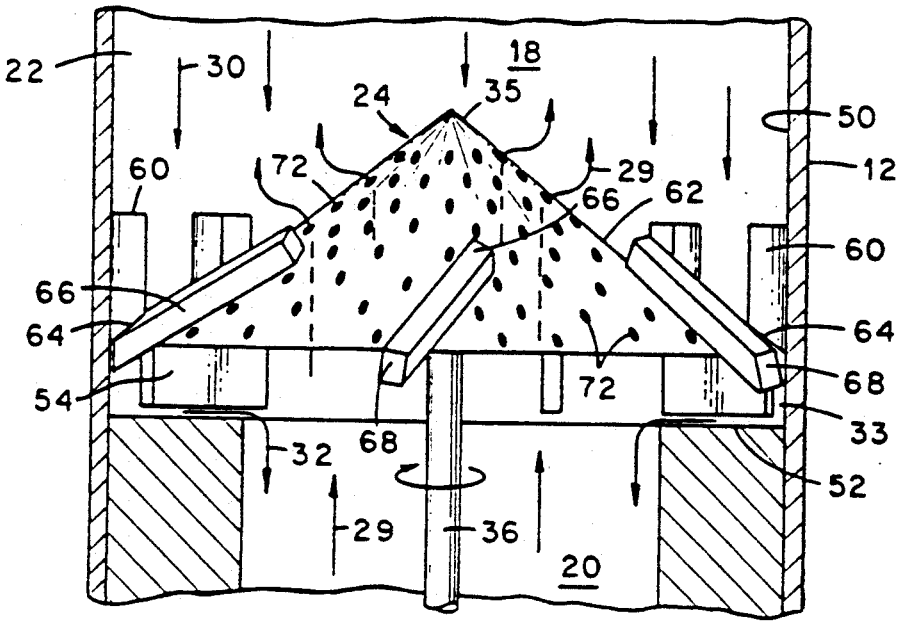
FIG. 2 is an enlarged vertical sectional view of the grate assembly of FIG. 1 which provides more details of the solids crushing mechanism and the orientation of the passageways through the grate used for the selective distribution of reactant gases into the gasification zone.
Figure 3:
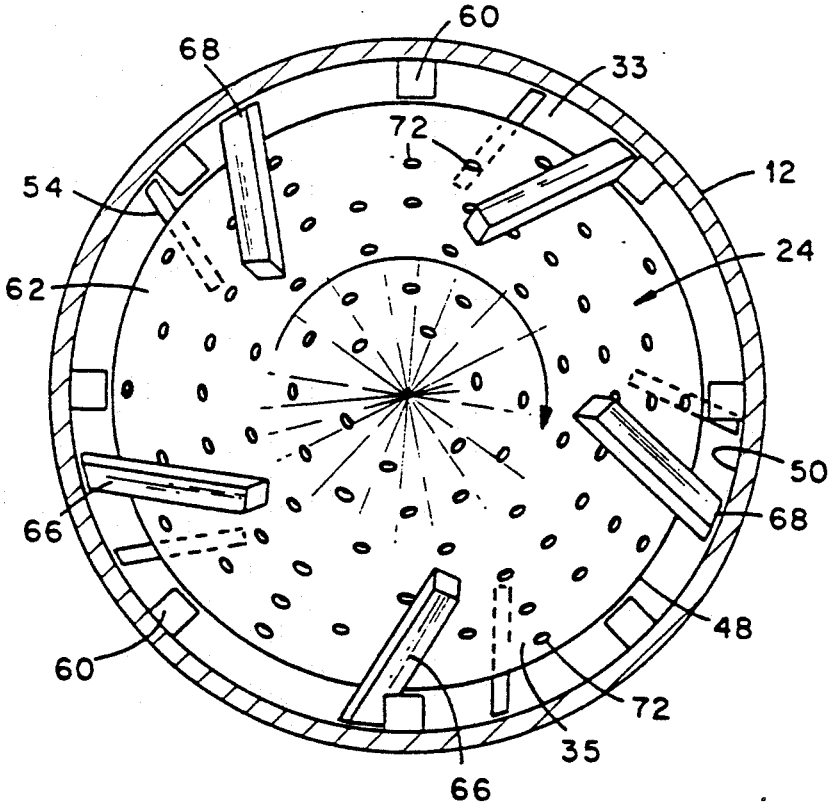
FIG. 3 is a top plan view of the FIG. 2 arrangement and illustrates further details of the grate assembly.

With reference to FIGS. 1-3, a typical fixed-bed coal gasifier is illustrated at 10 and is formed of a vertically oriented housing 12 having a cylindrical chamber 14 provided with an upper region 16, a generally central region 18, and a lower region 20. The central region 18 defines a gasification and combustion zone 22 that is separated from the lower region 20 by a grate assembly 24. Coal is introduced into the gasification zone through an inlet 26 in the upper region 16 for contact with high temperature gases, usually in the form of a mixture of steam and air. The gases are introduced into the gasifier 10 through inlet 28 in the lower region 20 and pass through the grate assembly 24 and into the gasification and combustion zone 22, as indicated by arrows 29, to react with and gasify the downwardly moving coal as indicated by arrows 30 for providing a combustible product gas which is discharged from the gasifier housing 12 through discharge line 31. The gasification reaction proceeds as the coal descends through the gasification and combustion zone 22 until substantially all of the energy values in the coal have been converted to product gas. The solid residue or ash resulting from the gasification and combustion reactions, as generally indicated by arrows 32, is discharged from the gasification and combustion zone 22 by passing through an opening or passageway 33 in the grate assembly 24 and into the lower region 20 of the gasifier to a discharge line 34.

The solid residue, depending upon the characteristics of the coal and reaction conditions, may form clinkers composed of fused-together ash particulates. These clinkers are frequently found to be too large to pass through the grate such as by the passageway 33 provided around the peripheral edges of the grate assembly 24 and thus must be disposed of by reducing the size of the clinkers to smaller sized particulates which will pass through the grate or by taking the gasifier off-line and physically removing the clinkers.

In accordance with the present invention, the grate assembly 24 as best illustrated in FIGS. 1-5 provides for the crushing of such clinkers and the selective distribution of reactant gases into the gasification and combustion zone 22. As shown, the grate assembly 24 is provided by a conical or convex configured grate 35 having the apex thereof facing the gasification and combustion zone 22 and in alignment with the vertical axis of the housing 12. The upper surface of the conical grate 35 is inclined at an angle to the horizontal so as to be substantially equal to or slightly greater than the angle of repose which corresponds to the average size of the solid particulate resting upon the upper surface of the grate 35. In typical fixed-bed coal gasification and combustion operation, an angle of about 20 to 40 degrees is usually suitable for ash displacement down the inclined grate 35. The conical grate 35 is rotatably mounted within the housing 12 and is supported by a suitable carriage and bearing arrangement including a drive shaft 36 and a gear box 38. A further drive shaft 40 is coupled to the gear box and a suitable drive motor 42 for rotating the grate 35 at a selected speed which is usually about one revolution per hour in a typical coal gasification and combustion operation. This rotation of the grate 35 tends to disturb any solids resting upon the upper surface of the grate 35 to enhance the movement or the tumbling of the solids down the inclined upper surface of the grate 35 so as to facilitate the passing of the ash particulates from the gasification and combustion zone 22 into the lower region 20 of the housing 12 through an annular passageway 33 provided between the peripheral edge 48 of the grate 35 and the inner walls 50 of the gasifier housing 12. These ash particulates, after passing through the passageway 33, fall towards the ash outlet 34 as generally shown by the arrows 32.

As shown in FIGS. 1-3, the lower region 20 of the gasifier is provided with an annular sleeve 52 bearing against the inner walls 50 of the housing 12 for forming an ash shelf or pan that is positioned under and slightly vertically spaced from the annular passageway 33. Ash particulates collecting on this shelf 52 as they pass through the passageway 33 are moved radially inwardly from the perimeter of the lower region 20 for discharge through the central opening provided through the annular sleeve 52 so as to fall into an ash hopper (not shown) coupled to the discharge line 34. This radial movement of the ash from the annular shelf is provided by employing vertically oriented and radially angled blades 54 on the under side of the grate 35 at circumferentially spaced apart locations.

In FIG. 1, the drive motor 42 for the grate 35 is shown as being provided by a hydraulic motor having a drive controller 56 responsive to a fluid pressure sensor 58 coupled to the hydraulic motor 42 for temporarily reversing the direction of the rotation of the grate 35 in response to a selected increase in the fluid pressures required for the operation of the motor 42 during the crushing of a clinker. Alternatively, the drive motor 42 may be provided by a suitable electric or other power driven motor that utilizes a torque responsive mechanism capable of stopping and temporarily reversing the direction of grate rotation when the torque responsive mechanism senses that a clinker is not being adequately crushed and is hanging up within the gasifier so as to impede the normal rotation of the grate 35. The temporary reversal in the direction of grate rotation displaces and reorients the clinker on the upper surface of the grate 35 for subsequent crushing thereof as will be described below.

The clinker-crushing capability of the grate assembly 24 is achieved by providing the inner walls 50 of the gasifier housing 12 with stationary, vertically extending rods or bars 60 which are mounted in a common horizontal plane and are of a rectangular configuration and of a thickness substantially corresponding to the cross-sectional width of the annular passageway 38. Normally a thickness of the bars 60 in a range of about 1.0 to 4.0 inches is adequate for the contacting and retaining a clinker for effecting the crushing thereof as will be described below. These stationary bars 60 are circumferentially spaced apart about the inner walls 50 of the housing 12 at selected locations, preferably at uniformally spaced apart locations. The lower end portion of each bar 60 is vertically spaced from the upper surface 62 of the grate 35 and is provided with a tapered end surface 64 which is inclined at an angle substantially parallel to the incline angle of the conical grate 35. These bars 60 are of configuration and size which will provide minimal resistance to the downward movement of the solids through the gasification and combustion zone 22. Also, if desired but not shown, the upper surfaces of the bars 60 may be tapered so as to further reduce the resistance to the downward flow of solids through the gasification zone 22.

A further component of the clinker-crushing arrangement is provided by crusher rods or bars 66 which are mounted on the upper surface 62 of the grate 35. These bars 66 are each of an elongated rectangular configuration with the lower end 68 thereof projecting beyond the rim or peripheral edge 48 of the grate 35 and substantially through the cross section of the annular passageway 33 with the end 68 of the bars terminating near, i.e. about 0.3 to 1.0 inch from, the inner walls 50 of the housing 12. The end 68 of each bar 66 is tapered an angle of about 50 to 70 degrees so as to be substantially parallel to the inner walls 50. The thickness of the bars 66 is in a range of about 1.0 to 4.0 inches, which thickness is slightly less, i.e. about 0.3 to 1.0 inch, than the spacing between the upper surface 62 of the grate 35 and the lower end surface 64 of the stationary bars 60 so that the lower end portion of the bars 66 will pass under the end surface 64 of the bars 60 during the rotation of the grate 35. The bars 66 are positioned on the upper surface 62 of the grate 35 at an angle whereby the lower end of each bar 66 precedes the upper end portion of each bar 66 during the rotation of the grate 35. This angled positioning of the bars 66 so orients the leading edges of the bars 66 in the form of a compound angle with the stationary bars 60. In other words, considering the gasifier housing 12 as a vertical cylinder surrounding the base of the grate 35, a line coincident with the vertical edge of each grate mounted bar 66 would be at an angle with both a horizontal radius line of the gasifier cylinder and a vertical element line of the gasifier cylinder. This positioning of bars 66 relative to bars 60 provides a "backrake" and results in an "upward" force vector and a mechanism to move a clinker which does not crush up out from between one particular pair of bars 66 and 60 and allows it to be repositioned and addressed by a subsequent pair of bars. A suitable value for the compound angle between the bars 66 and 60 is in the range of about 45 to 75 degrees.

Figure 4:
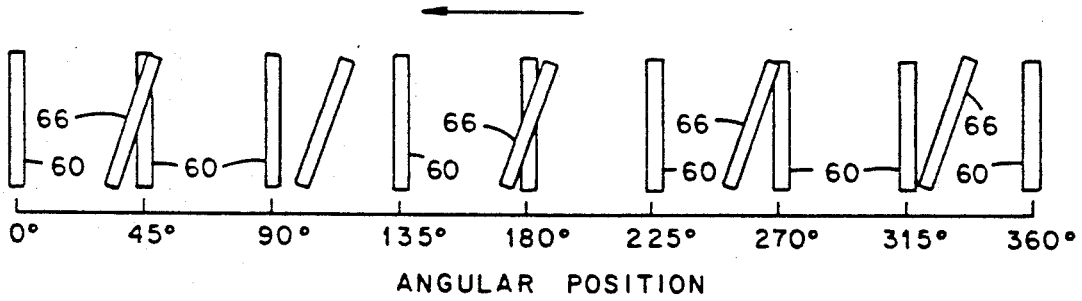
FIG. 4 is a schematic view illustrating, over a 360° span, the positions of the crusher bars supported by the rotatable grate relative to the stationary crusher bars supported on the inner walls of the gasifier.
Figure 5:
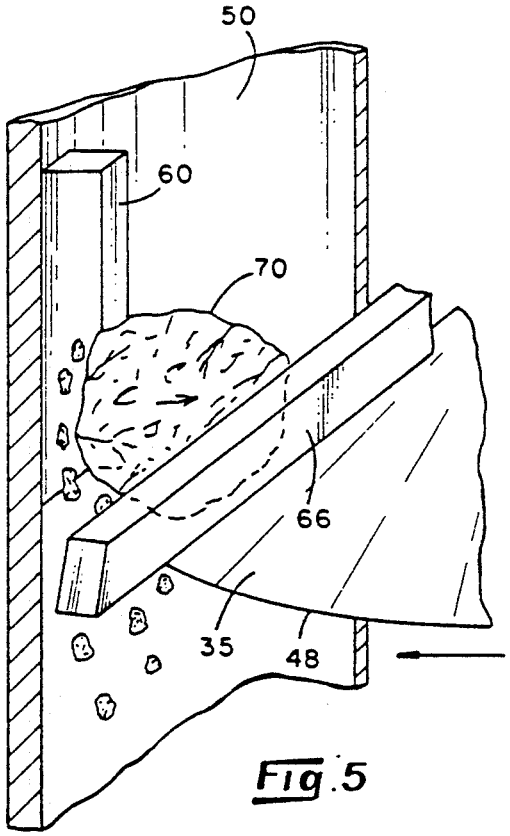
FIG. 5 is a fragmentary vertical sectional view illustrating a typical crushing operation of a clinker as provided by the rotatable grate assembly of FIG. 1.

As shown in FIGS. 2-4, the number of the grate-mounted bars 66 used in the grate assembly is different than the number of the stationary bars 60 so as to assure that no more than one pair of the clinker-crushing bars 60 and 66 will come into close proximity to one another at the same time and thereby minimize the peak torque requirements on the grate 35 and its drive system. As an example, as illustrated in FIG. 4, the pitch spacing of the bars is such that the bars 60 and 66 enter into a clinker contacting relationship at different times and the pair of bars 60 and 66 at the 45° location is just completing its crushing encounter while the pair of bar 60 and 66 at the 315° location is just initiating the encounter. Other pairs of bars 60 and 66 can be seen to be at other phases of the crushing encounter.

As occasionally happens during the operation of a typical fixed-bed gasifier, a clinker 70 (FIG. 5) is formed that is too large to pass through the passageway 33 between the rim 48 of the grate 35 and the inner walls 50 of the gasifier housing 12. When such a clinker is formed, it will slide down the upper surface 62 of the grate 35 and will ride the rotating grate 35 until the clinker 70 encounters a wall mounted crusher bar 60 and is stopped thereby. As the grate 35 continues to rotate, a bar 66 on the surface 62 of the grate 35 contacts an opposite side of the clinker 70 and pinches the clinker 70 between the moving bar 66 and the stationary bar 60. As the pinching force exerted on the clinker increases with the rotation of the grate 35, the clinker 70 is usually either completely fractured with small fragments thereof falling through the annular passageway 33 or else the clinker is only partially fractured. If such partial fracturing occurs or if the clinker fails to undergo partial fracturing, the upward vector component of the crushing force is sufficient to displace the oversized clinker 70 upwardly along the upper surface 62 of the grate 35 and away from the particular pair of bars 60 and 66 thereby disengaging the clinker 70 from the crushing action. By so displacing the unbroken clinker 70 upward and away from engagement with a vertical bar pair, the mechanical stalling of the grate 35, due to the clinker 70 being lodged between a stationary pair of one vertical bar 60 and a grate-mounted rotating bar 66, is obviated so that the grate 35 may continue to rotate. With continued rotation the clinker 70 will be addressed by the next pair of a vertical bar 60 and a grate-mounted bar 66 as it again slides down the inclined grate 35 to rest against the inner walls 50 of the housing 12.

In as much as clinkers are normally irregular in configuration and nonisotropic, the random positioning of the clinker on the grate 35 can be expected to occur as it is displaced between successive breaker bars 60 so as to, in effect, at least position a "new" portion of the clinker between the bars 60 and 66 for "pinching-off" another piece of the clinker. This process of moving the unbroken clinker upwardly and then downwardly between the successive bars 60 and 66 is repeated until the size of the clinker is reduced to a size fraction sufficiently small to pass through the annular passageway 33.

The grate assembly 24 of the present invention is not expected to function as a highly efficient clinker crushing mechanism, rather the grate assembly 24 provides for the crushing of the clinkers by repeated abrasion or partial fragmentation of the clinker until it is essentially totally fragmented.

In addition to the capability to reposition an oversize clinker 70 between successive bar pairs 60 and 66, the reliability of the clinker crushing process is enhanced by providing a capability to rotate the grate 35 in a direction opposite to the normal direction of rotation when an exceptionally large or tenaciously fused clinker is encountered by the bars 60 and 66 and it fails to be crushed or moved sufficiently upwardly and out of contact with a pair of bars 60 and 66. As briefly described earlier, this reversing feature for preventing the grate from stalling is achieved by using the fluid pressure sensor 58 which is coupled to the controller 56 for reversing the rotation of the hydraulic motor 42 when a predetermined level of excess hydraulic pressure is sensed at the sensor 56. Upon such an indication of excess pressure on the drive train, the rotation of the grate 35 in the normal or first direction is terminated and then reversed to rotate in a second direction for approximately 5° to 30° of travel. This extent of reverse travel is sufficient to randomly reposition the clinker on the upper surface 62 of the grate 35. By repositioning the clinker 70 and then re-initiating the rotation of grate 35 in the normal direction, the repositioned clinker 70 will again be subjected to the crushing action by the bars 60 and 66 to provide for additional or complete fragmentation of the clinker. By using this reversing action for the repositioning of the clinker, an exceptional clinker encountered during the operation of the grate can usually be fragmented without taking the gasifier off-line so as to physically remove the clinker. During clinker crushing operations, solid ash particulates of a size sufficient to pass through the passageway 33 are discharged from the gasification and combustion zone 22 without being impeded by the grate drive mechanism 38.

In order to provide for the desired flow of reactant gases through the grate 35 into the gasification and combustion zone 22, the grate 35 is provided with a plurality of gas orifices or passageways 72 through the grate 35. These passageways 72 extend through the grate 35 in a substantially horizontal plane and are generally perpendicular to the path of the downwardly moving solids in the gasification and combustion zone 22 so as to reduce the intrusion of descending solids into these passageways 72 and the consequent likelihood of any plugging of the passageways 72. The spacing or pattern of the passageways 72 in the grate 35 can be tailored for each gasifier arrangement so as to provide both a desired level of grate cooling and the radial distribution of reactant gases into the gasification and combustion zone 22. With the horizontal distribution of the reactant gases into the gasification and combustion zone 22, as soon as they exit from the passageways 72, the reactant gases turn upwardly into the bed of the downwardly moving solids. Thus, by using the horizontal passageways 72, an arrangement is also provided wherein the distribution of reactant gases within the gasification and combustion zone 22 can be tailored to achieve the desired flow of reactants through the gasification and combustion zone 22 for achieving maximum gasification and combustion efficiency.

Figure 6:
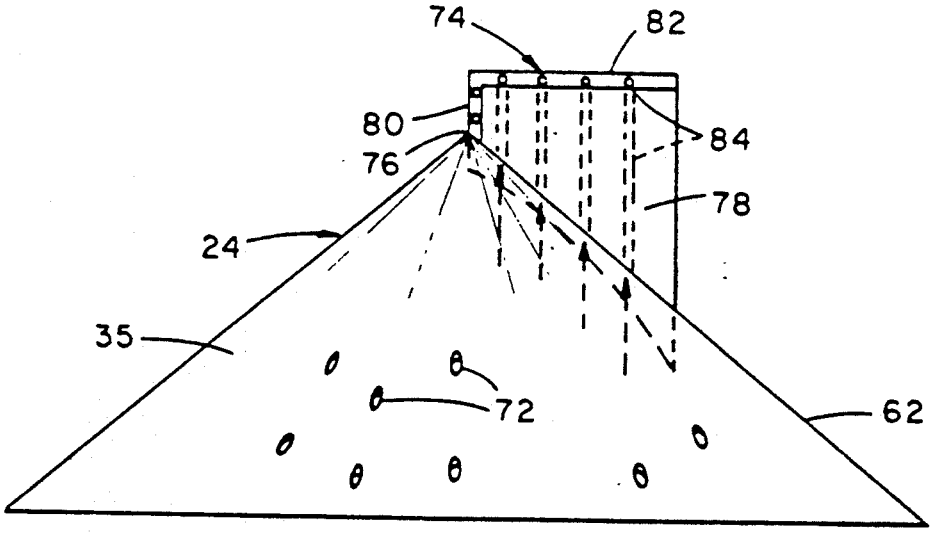
FIG. 6 is a vertical view illustrating a further embodiment of the grate assembly of the present invention which provides a scoop mechanism for the selective distribution of solids within the gasification zone and which can be incorporated with the embodiment of FIG. 1.
Figure 7:
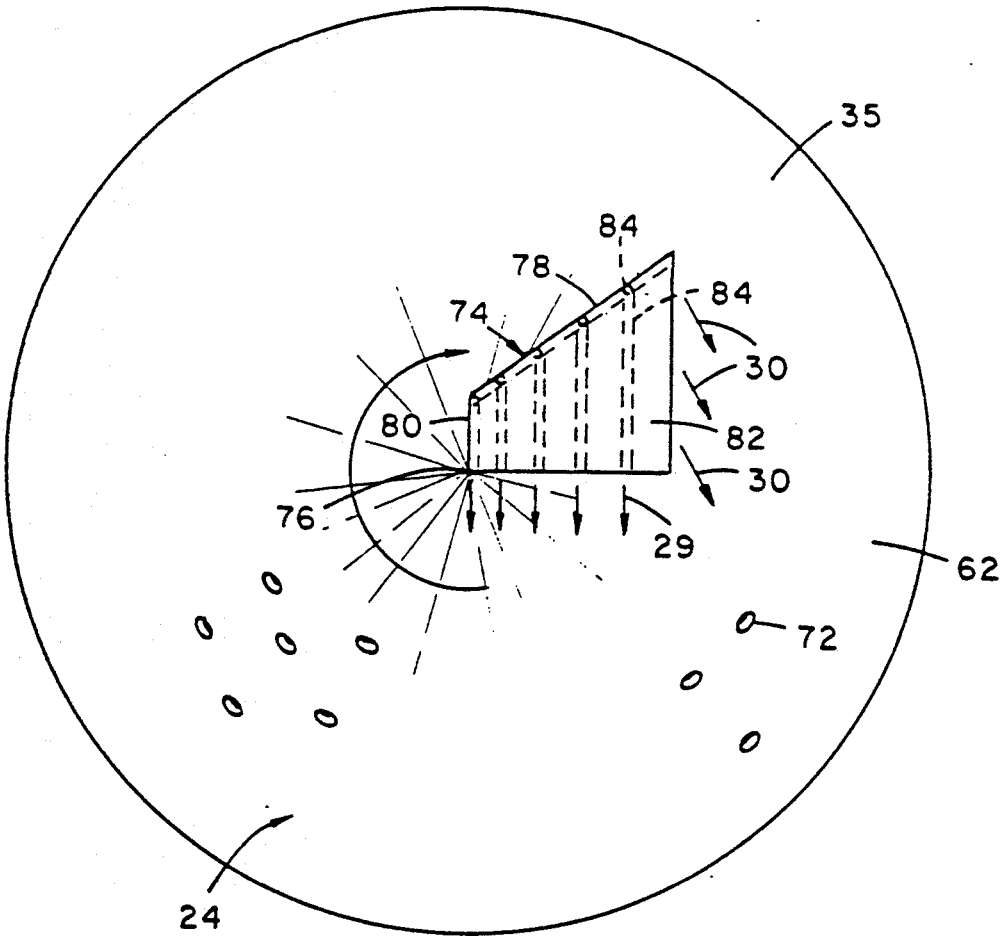
FIG. 7 is a top plan view of the FIG. 6 embodiment showing further details of the scoop mechanism.

With reference to FIGS. 6 and 7, the tailoring of the radial distribution of the downward solid flow velocities within the gasification and combustion zone 22 is achieved by providing a deflector or scoop 74 which is mounted near the upper end or apex 76 of the grate 35. A scoop 74 is illustrated which would increase downward flow velocities in the central region of the gasification and combustion zone 22. However, if desired, a deflector could also be utilized to retard velocities of solids in this central region. The illustrated configuration of scoop 74 is defined by a backwall 78 and a sidewall 80. The backwall 78 extends down the inclined upper surface 62 of the grate 35 along a plane substantially parallel to a radius of the grate 35 for a distance equal to about 20 to 40 percent of the grate radius. The upper end of the backwall 78 is laterally spaced about 2 to 15 percent of the grate radius from the apex 76 of the grate where the upper end of the backwall 78 is joined at an angle to the vertical sidewall 80 which extends to the apex 76 of the grate 35. The backwall 78 and the sidewall 80 of the illustrated configuration are attached to a topwall 82 of a generally right triangular configuration. The scoop 74 is configured to collect and radially expell solids from the central region of the gasification and combustion zone 22 towards the peripheral regions of the gasification and combustion zone 22.

The actual size, mounting angle, and shape or configuration of the scoop 74, and the volume of solids being swept by the scoop 74 in a radial direction away from the central region of the gasification and combustion zone 22 towards peripheral regions of the gasification and combustion zone 22 are variables that can be preselected for use in a particular gasification and combustion operation. By so configuring the scoop 74, a desired relationship is provided between the flow rate of the downwardly moving solids in the central region of the gasification and combustion zone 22 as compared to the flow rate of the downwardly moving solids in the peripheral region of the gasification and combustion zone 22. The illustrated scoop 74, in effect, augers the solids from the central portion of the solids bed and forces the solids to move downwardly and outwardly so that during each rotation of the grate 35, a relatively larger volume of solids is removed from the central region of the gasification and combustion zone 22 than is removed from the peripheral regions of the gasification and combustion zone 22 through the annular passageway 33. Thus, this relative proportioning of the solids removed and the radial distribution of these downwardly flowing solids is a primary function of the specific shape and angle of the scoop 74. In a particular coal gasifier, it is likely that the areal solids flow rate should be greater in the central region of the solids bed than in peripheral regions of the solids bed. However, by properly selecting the angle and configuration of the scoop 74, the areal flow rate in the central region of the gasification and combustion zone 22 can be made to be equal to, less than, or greater than that of the downward flow of solids in the peripheral region of the gasification and combustion zone 22.

Cooling of the scoop 74 is likely to be necessary and may be achieved in any suitable manner such as by providing gas passageways such as generally shown at 84 and contained within the backwall 78, the sidewall 80, and the top wall 82. Alternatively, the coolant passageways 84 can be attached to the underneath side (protected side) of the scoop 74.

It will be seen that the present invention provides for the effective crushing of clinkers within coal gasifiers. A capability is also provided for the selective radial distribution of the reactant gases across the gasification and combustion zone and the selective radial distribution of downwardly moving solid velocities within the gasification and combustion zone in a manner heretofore unattainable.

What is claimed is:

1. A grate assembly in combination with a gasifier of carbonaceous material comprising a vertically oriented housing having inner wall regions forming a cylindrical chamber defining a gasification zone intermediate upper and lower regions of the housing and provided with inlet means and outlet means in the upper region of the housing for respectively introducing coal into the housing and removing product gases resulting from the gasification of the carbonaceous material in the gasification zone and with inlet means and outlet means in the lower region of the housing for respectively introducing a stream of reaction supporting gases into the chamber and discharging solids from the chamber, said grate assembly comprising:

a generally conical grate rotatably supported in said chamber at a location underlying the gasification zone for supporting solid reactants in the gasification zone, said conical grate having upper surface regions with an upward angle of incline from peripheral edge regions toward a central apex thereof facing the gasification zone and a diameter slightly less than the inner diameter of the chamber for defining an annular passageway between said inner wall regions and peripheral edge regions of the grate for the discharge of solid material from the gasification zone;

said grate defining a plurality of throughgoing passageways extending between inner surface regions and said outer surface regions of the conical grate for distributing the stream of reaction supporting gases within the gasification zone;

a plurality of elongated vertically oriented first bar means supported on said inner wall regions in a substantially common plane, each bar means having a lower end thereof overlying said annular passageway and positioned at a location substantially vertically spaced from said peripheral edge regions of the grate;

a plurality of elongated second bar means each supported on and extending from a radial inner region of said upper surface regions of the grate with one end portion of each of said second bar means disposed closer to said inner wall regions than the peripheral edge regions of the grate and in a horizontal plane underlying said lower end of said first bar means; and means for rotating said grate in a first direction for contacting and crushing an agglomerate of solid material between the first and second bar means when the agglomerate is of a size larger than the cross section of said annular passageway, and wherein said means for rotating the grate comprises hydraulic motor means, and wherein switch means are arranged to trigger the rotation of the conical grate in an opposite direction for a preselected portion of a single revolution sufficient to reposition an agglomerate of solid material on the upper surface region of the grate in response to a preselected pressure increase in the hydraulic motor means due to an agglomerate of solid material inhibiting the rotation of the grate.

2. A grate assembly for use in a gasifier of carbonaceous material as claimed in claim 1; wherein said one end portion of each of said second bar means project over said peripheral edge regions of the grate and into said annular passageway for positioning said one end portion of said second bar means in a vertical plane underlying said lower end of said first bar means.

3. A grate assembly for use in a gasifier of carbonaceous material as claimed in claim 2; wherein each of said second bar means is disposed on said upper surface regions of said grate at an angle to said first bar means that is sufficient to effect the displacement of the agglomerate along the second bar means in an upward direction after the contacting thereof with the first and second bar means.

4. A grate assembly for use in a gasifier of carbonaceous material as claimed in claim 3; wherein the upper surface region of said conical grate is inclined at angle to a horizontal plane of the chamber that is substantially equal to the angle of repose of the average size of solid material supported on the upper surface region of the grate.

5. A grate assembly for use in a gasifier of carbonaceous material as claimed in claim 4; wherein said angle of each of said second bar means is defined by positioning each said second bar means on the upper surface region of the grate so that a lower end portion of each said second bar means precedes an upper end portion thereof during rotation of the grate in a first direction.

6. A grate assembly for use in a gasifier of carbonaceous material as claimed in claim 5; wherein said first bar means and said second bar means are respectively substantially uniformly spaced apart from one another, and wherein the number of said second bar means differs from that of said first bar means for preventing substantially the same proximal positioning of more than one pair of said second bar means with any of said first bar means at any point of rotation of the conical grate.

7. A grate assembly for use in a gasifier of carbonaceous material as claimed in claim 5; wherein each of said first bar means and each of said second bar means is of a rectangular configuration, and wherein the cross-sectional thickness of the first bar means substantially corresponds to the cross-sectional width of said annular passageway.

8. A grate assembly for use in a gasifier of carbonaceous material as claimed in claim 7; wherein the end of each of said first bar means is inclined at an angle substantially corresponding to the angle of incline of the upper surface region of the conical grate, wherein the lower end of each of said first bar means is spaced from the upper surface region of the conical grate a distance slightly greater than the cross-sectional thickness of the second bar means, and wherein the end of said one end portion of each said second bar means is inclined at an angle substantially parallel to the angle of incline of the upper surface region of the conical grate and is disposed in a location in said annular passageway in close proximity to said inner wall regions of the housing.

9. A grate assembly for use in a gasifier of carbonaceous material as claimed in claim 1; wherein annular shelf means are supported by said inner wall regions of the housing at a location underlying said annular passageway, and wherein a plurality of radially angled blade means are supported by said conical grate adjacent to the peripheral edge regions thereof at a location intermediate to the conical grate and said shelf means for displacing solid material from the latter.

10. A grate assembly for use in a gasifier of carbonaceous material as claimed in claim 1; wherein each of the plurality of throughgoing passageways in the conical grate is disposed at an angle generally perpendicular to the vertical axis of the chamber and sufficient to deter the plugging of any of said throughgoing passageways by solid material contactable with the conical grate.

11. A grate assembly for use in a gasifier of carbonaceous material as claimed in claim 1; wherein vertically oriented and generally radially extending scoop means are supported on the upper surface regions of the conical grate at a location adjacent to the apex of the conical grate, and wherein the scoop means is of sufficient radial dimensions for displacing solids from a central region of the chamber overlying the conical grate towards peripheral regions of the chamber surrounding the central region of the chamber.

12. A grate assembly for use in a gasifier of carbonaceous material as claimed in claim 11; wherein the scoop means is defined by vertical wall means and substantially horizontal top wall means supported by the vertical wall means, and wherein a portion of the vertical wall means extend from a location adjacent to the apex of the conical grate towards the peripheral regions thereof.

13. A grate assembly for use in a gasifier of carbonaceous material as claimed in claim 12; wherein the scoop means is positioned at an angle to the radius and is of a size sufficient to displace a selected portion of the solid material from the central region of the chamber towards the peripheral region thereof.

14. A grate assembly for use in a gasifier of carbonaceous material as claimed in claim 13; wherein means are operatively associated with said scoop means for cooling the latter.

* * * * *